US008069583B1

(12) United States Patent
Simchuk

(10) Patent No.: US 8,069,583 B1
(45) Date of Patent: Dec. 6, 2011

(54) SHOE WITH REPLACEMENT SOLE CARTRIDGES

(76) Inventor: Mark L. Simchuk, Grants Pass, OR (US)

( * ) Notice: Subject to any disclaimer, the term of this patent is extended or adjusted under 35 U.S.C. 154(b) by 718 days.

(21) Appl. No.: 12/004,196

(22) Filed: Dec. 20, 2007

Related U.S. Application Data

(60) Provisional application No. 60/997,232, filed on Oct. 1, 2007.

(51) Int. Cl.

| | |
|---|---|
| ***A43C 13/00*** | (2006.01) |
| ***A43B 13/14*** | (2006.01) |
| ***A43B 21/36*** | (2006.01) |
| ***A43B 13/00*** | (2006.01) |

(52) U.S. Cl. ..... 36/15; 36/103; 36/31; 36/42

(58) Field of Classification Search ..... 36/100, 36/103, 12, 15, 23, 24, 25 R, 31, 36 R–36 C, 36/42

See application file for complete search history.

(56) References Cited

U.S. PATENT DOCUMENTS

| | | | | | |
|---|---|---|---|---|---|
| 1,142,662 | A | * | 6/1915 | Blaney | 36/36 R |
| 1,642,991 | A | * | 9/1927 | Fowler | 36/36 R |
| 1,831,268 | A | * | 11/1931 | Starks | 36/36 R |
| 2,582,551 | A | * | 1/1952 | Malherbe | 36/42 |
| 3,019,534 | A | * | 2/1962 | Kauffman et al. | 36/15 |
| 3,526,976 | A | * | 9/1970 | Jacobs | 36/100 |
| 3,538,628 | A | * | 11/1970 | Einstein, Jr. | 36/15 |
| 4,214,384 | A | | 7/1980 | Gonzales | |
| 4,279,083 | A | | 7/1981 | Dilg | |
| 4,317,294 | A | | 3/1982 | Goodyear | |
| 4,351,120 | A | * | 9/1982 | Dalebout | 36/117.3 |
| 4,499,674 | A | * | 2/1985 | Olivieri | 36/117.3 |
| 4,811,500 | A | * | 3/1989 | Maccano | 36/91 |
| 5,025,547 | A | | 6/1991 | Sheu et al. | |
| 5,317,822 | A | | 6/1994 | Johnson | |
| 5,373,649 | A | * | 12/1994 | Choi | 36/42 |
| 5,519,950 | A | | 5/1996 | Wang | |
| 5,615,497 | A | | 4/1997 | Meschan | |
| 6,065,228 | A | * | 5/2000 | Begey et al. | 36/15 |
| 6,389,712 | B1 | | 5/2002 | Schelling | |
| 6,711,835 | B1 | | 3/2004 | Militello | |
| 7,185,448 | B2 | * | 3/2007 | Schupbach | 36/42 |
| 7,246,453 | B2 | | 7/2007 | Kim | |
| 7,254,905 | B2 | | 8/2007 | Dennison | |
| 7,331,123 | B2 | * | 2/2008 | Workman et al. | 36/15 |
| 7,434,335 | B2 | * | 10/2008 | Feldstein | 36/8.3 |
| 7,461,469 | B2 | * | 12/2008 | McClaskie | 36/11.5 |
| 7,578,075 | B1 | * | 8/2009 | Kemp | 36/100 |
| 2005/0246923 | A1 | * | 11/2005 | Bergamin | 36/131 |
| 2006/0042119 | A1 | | 3/2006 | Workman et al. | |

* cited by examiner

*Primary Examiner* — Jila Mohandesi
*Assistant Examiner* — Melissa Lalli
(74) *Attorney, Agent, or Firm* — Jerry Haynes Law

(57) ABSTRACT

A shoe with replaceable shoe cartridges includes a shoe frame having a forefoot portion, a middle portion extending from the forefoot portion and a heel portion extending from the middle portion; a sole provided on the shoe frame; a forefoot sole cartridge removably engaging the sole at the forefoot portion of the shoe frame; and a heel sole cartridge removably engaging the sole at the heel portion of the shoe frame.

4 Claims, 5 Drawing Sheets

SHOE WITH REPLACEMENT SOLE CARTRIDGES

CROSS-REFERENCE TO RELATED APPLICATIONS

This application claims the benefit of and incorporates by reference in its entirety U.S. Provisional application Ser. No. 60/997,232, filed Oct. 1, 2007 and entitled "Multisport Athletic Shoe Replacement Sole Cartridge (RSC) Shoe Rail/Channel Replacement Cartridge".

FIELD

The present disclosure generally relates to shoes with replaceable soles. More particularly, the present disclosure relates to a shoe having replaceable forefoot and heel sole cartridges.

BACKGROUND

Over time, athletic shoes have evolved to forms which are specific to particular running or playing surfaces on which the shoe is intended to be used as well as to particular foot types. A person may possess various types of athletic shoes depending on particular sports the person plays or particular type or types of running surface on which the person runs. Many athletic shoes, particularly running shoes, are often discarded after a few months of use since the midsole and outer sole materials of such shoes have a tendency to break down early with continuous use. This leads to early failure of the shoe's ability to provide stability and shock absorption.

Therefore, a shoe with replaceable forefoot and heel sole cartridges is needed which prolongs the durability and usability of the shoe and which can be customized to a particular shoe type depending on the needs and desires of the wearer. Furthermore, one athletic shoe can be customized to a sport, foot type, or surface type.

SUMMARY

The present disclosure is generally directed to a shoe with replaceable shoe cartridges. An illustrative embodiment of the shoe includes a shoe frame having a forefoot portion, a middle portion extending from the forefoot portion and a heel portion extending from the middle portion; a sole provided on the shoe frame; a forefoot sole cartridge removably engaging the sole at the forefoot portion of the shoe frame; and a heel sole cartridge removably engaging the sole at the heel portion of the shoe frame. Both forefoot and rearfoot sole cartridges engage the locking bridge of the frame centrally.

DETAILED DESCRIPTION

Figure 1:
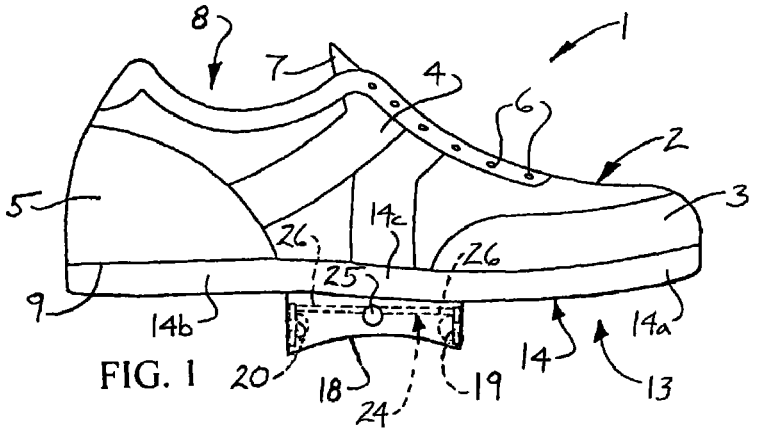
FIG. 1 is a side view of an illustrative embodiment of the shoe with replaceable sole cartridges, with a forefoot sole cartridge and a heel sole cartridge removed from a shoe frame of the shoe.

Referring initially to FIGS. 1-9 of the drawings, an illustrative embodiment of the shoe with replacement sole cartridges, hereinafter shoe, is generally indicated by reference numeral 1. Each shoe 1 is fabricated as a left-foot or a right-foot version of a pair of shoes 1 and includes a shoe frame 2 which may approximate the general size and shape of any of a variety of shoe types. In some embodiments, the shoe frame 2 may generally approximate the size and shape of an athletic shoe such as a tennis shoe, for example and without limitation. The shoe frame 2 may be a breathable nylon mesh material, for example and without limitation, and may be any of a variety of styles and colors. The shoe frame 2 may include a forefoot portion 3 and a middle portion 4 (also referred to as the "last of the shoe") 3, which extends rearwardly from the forefoot portion 3 and a heel portion, (also referred to as the "heel counter") 5 which extends rearwardly from the middle portion 4. A foot opening 8 extends into the shoe frame 2 between the middle portion 4 and the heel portion 5. A shoe tongue 7 may extend into the foot opening 8, beneath the middle portion 4. Multiple lace openings 6 may be provided in the middle portion 4 to facilitate lacing of the shoe 1. A sole 9 may be provided on the bottom surface of the shoe frame 2.

Figure 8:
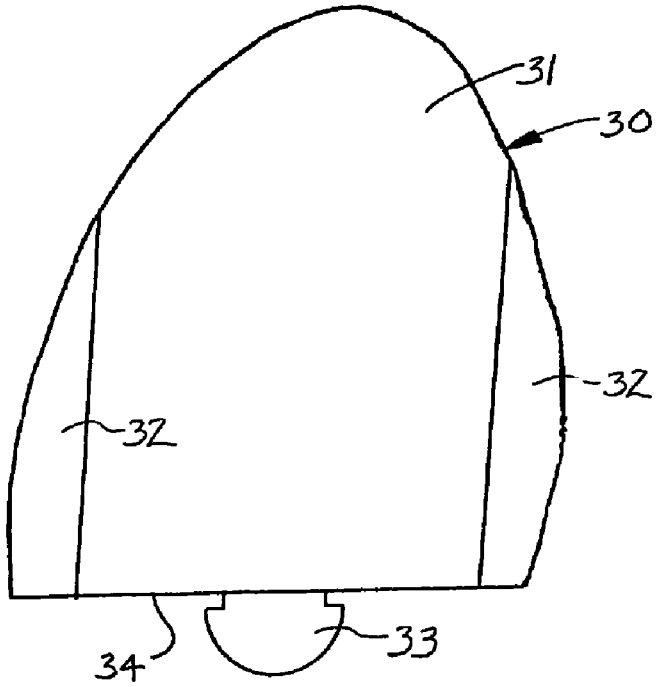
FIG. 8 is a top view of a forefoot sole cartridge of an illustrative embodiment of the shoe with replaceable sole cartridges.
Figure 9:
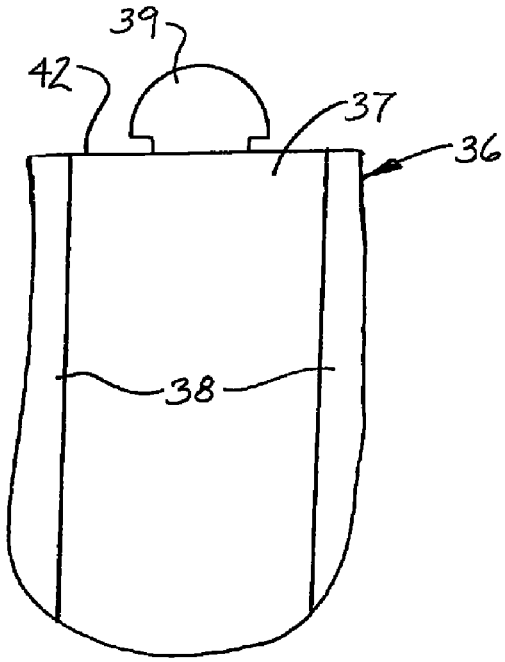
FIG. 9 is a top view of a heel sole cartridge of an illustrative embodiment of the shoe with replaceable sole cartridges.

As illustrated in FIGS. 2-6, a forefoot sole cartridge 30 and a heel sole cartridge 36 are each adapted to detachably engage the sole 9 at the forefoot portion 3 and the heel portion 5, respectively, of the shoe frame 2. As illustrated in FIG. 8, the forefoot sole cartridge 30 includes a forefoot cartridge body 31 having a size and shape which may generally approximate the size and shape of the forefoot portion of the sole 9 of the shoe frame 2. As illustrated in FIG. 9, the heel sole cartridge 36 includes a heel cartridge body 37 having a size and shape which may generally approximate the size and shape of the heel portion of the sole 9 of the shoe frame 2.

Figure 4:
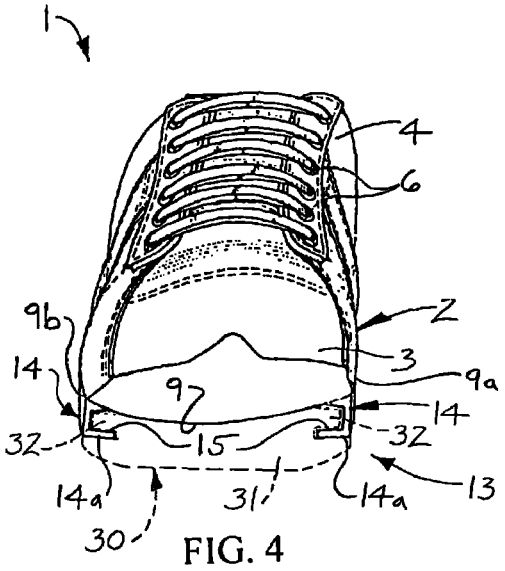
FIG. 4 is a front view of an illustrative embodiment of the shoe with replaceable sole cartridges, with the forefoot sole cartridge (illustrated in phantom) attached to the shoe frame.
Figure 5:
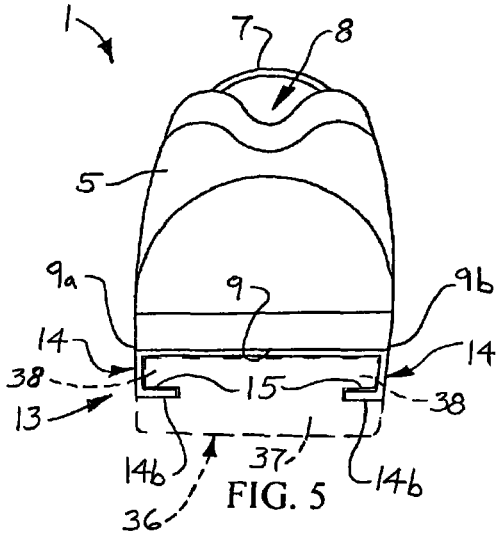
FIG. 5 is a rear view of an illustrative embodiment of the shoe with replaceable sole cartridges, with the heel sole cartridge (illustrated in phantom) attached to the shoe frame.
Figure 6:
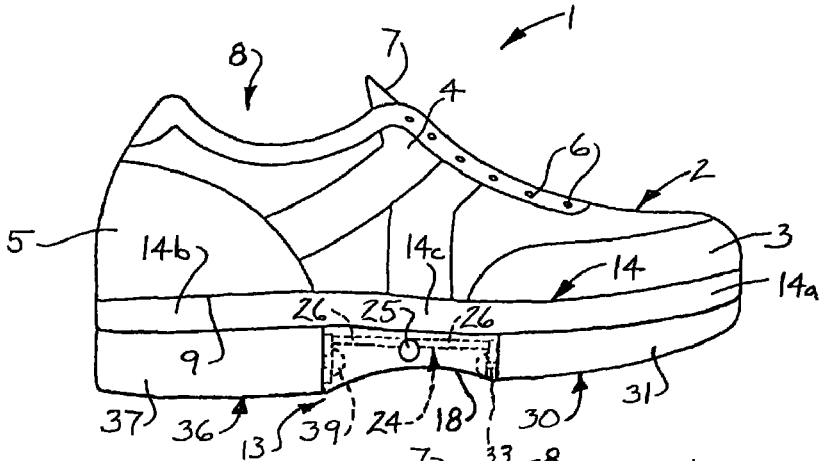
FIG. 6 is a side view of an illustrative embodiment of the shoe with replaceable sole cartridges, with the forefoot sole cartridge and the heel sole cartridge attached to the shoe frame.
Figure 7:
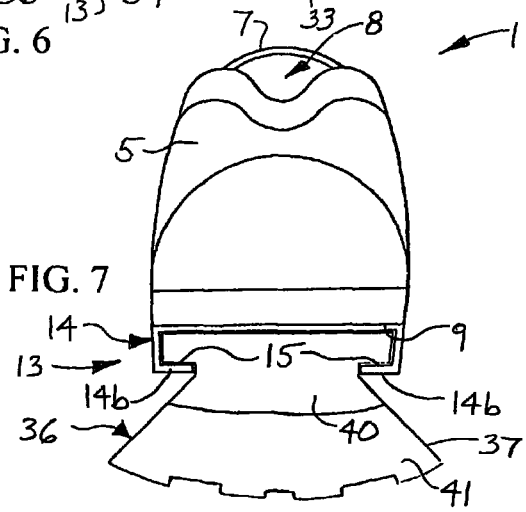
FIG. 7 is a rear view of an illustrative embodiment of the shoe with replaceable sole cartridges, with a rear sole cartridge of alternative configuration attached to the shoe frame.

As illustrated in FIG. 7, the heel cartridge body 37 of the heel sole cartridge 36 (and the forefoot cartridge body 31 of the forefoot sole cartridge 30) may include a midsole 40 and an outer sole 41 provided on the midsole 40. Furthermore, the midsole 40 and outer sole 41 may have a generally straight configuration, as illustrated in FIGS. 4 and 5; or an outwardly-flared configuration, as illustrated in FIG. 7. The midsole 40 may include various densities of EVA-type and/or polyurethane-type material and may be recyclable. The forefoot cartridge body 31 of the forefoot sole cartridge 30 and the heel cartridge body 37 of the heel sole cartridge 36 may be adapted for use on any of a variety of running or playing surfaces, according to the knowledge of those skilled in the art. For example, in embodiments in which the forefoot sole cartridge 30 and the heel cartridge body 37 are adapted for golf play, rubber cleats (not illustrated) may extend from each of the forefoot cartridge body 31 and the heel cartridge body 37. Each of the forefoot sole cartridge 30 and the heel cartridge 37 may be modified to conform to various foot types such as flat feet (which require a degree of stability) or high arched feet (which require cushioning).

As further illustrated in FIG. 8, a lock tab 33 may extend from a rear edge 34 of the forefoot cartridge body 31 of the forefoot sole cartridge 30. As further illustrated in FIG. 9, a lock tab 39 may extend from a front edge 42 of the heel cartridge body 37 of the heel sole cartridge 36. The purpose of the lock tab 33 and the lock tab 39 will be hereinafter described.

As illustrated in FIGS. 1-6, a cartridge guiding and locking assembly 13 may be provided on the sole 9 to facilitate removable attachment of the forefoot sole cartridge 30 and the heel sole cartridge 36 to the shoe frame 2. The cartridge guiding and locking assembly 13 may include a pair of spaced-apart cartridge channels 14 which extends along a medial side 9*a* and a lateral side 9*b*, respectively, of the sole 9, as illustrated in FIGS. 4 and 5. The cartridge channels 14 may be oriented in generally parallel relationship with respect to the longitudinal axis of the shoe frame 2. Each cartridge channel 14 may be a durable, rigid lightweight material such as polypropylene, carbon, TPU, for example and without limitation, and includes a channel slot 15, as further illustrated in FIGS. 4 and 5. The cartridge channels 14 include a pair of spaced-apart forefoot rail segments 14*a* provided on the sole 9 at the forefoot portion 3 and a pair of spaced-apart heel rail segments 14*b* provided on the sole 9 at the heel portion 5 of the shoe frame 2. As illustrated in FIGS. 1-3 and 6, a middle rail segment 14*c* may extend between the forefoot rail segment 14*a* and the heel rail segment 14*b* of each cartridge channel 14.

Figure 3:
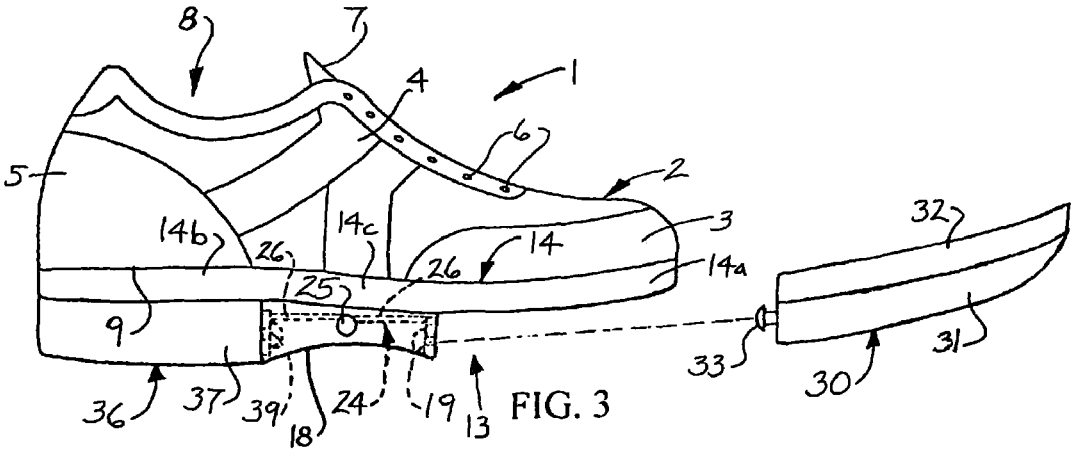
FIG. 3 is a side view of an illustrative embodiment of the shoe with replaceable sole cartridges, more particularly illustrating placement of the forefoot sole cartridge on the shoe frame of the shoe.

As illustrated in FIG. 8, a pair of spaced-apart forefoot cartridge rails 32 is provided along the respective lateral edges of the forefoot cartridge body 31 of the forefoot sole cartridge 30. As illustrated in FIG. 9, a pair of spaced-apart heel cartridge rails 38 is provided along the respective lateral edges of the heel cartridge body 37 of the heel cartridge 36. Accordingly, as illustrated in FIGS. 3 and 4, the forefoot cartridge rails 32 of the forefoot sole cartridge 30 are adapted to slidably engage the respective forefoot rail segments 14*a* of the respective cartridge channels 14. In like manner, the heel cartridge rails 38 of the heel sole cartridge 36 are adapted to slidably engage the respective heel rail segments 14*b* of the respective cartridge channels 14.

Figure 2:
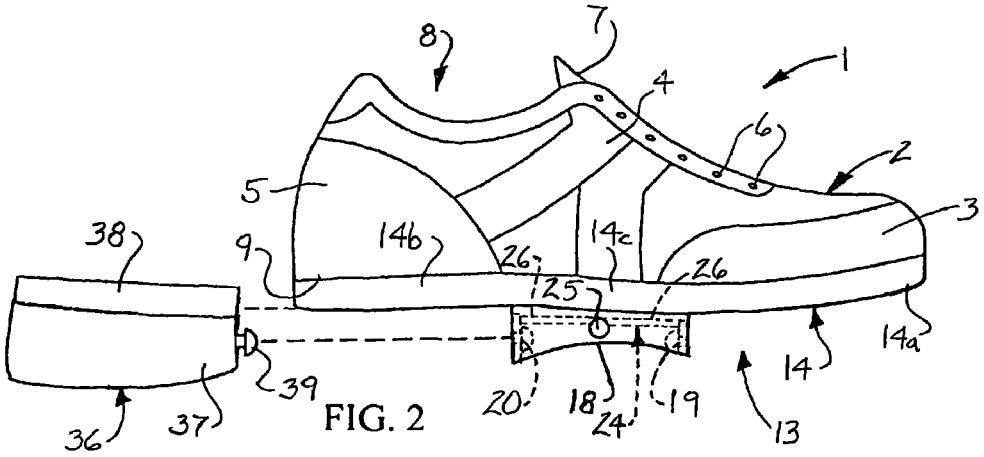
FIG. 2 is a side view of an illustrative embodiment of the shoe with replaceable sole cartridges, more particularly illustrating placement of the heel sole cartridge on the shoe frame of the shoe.

A lock bridge 18 extends from the middle rail segment 14*c* between the forefoot rail segment 14*a* and the heel rail segment 14*b*. The lock bridge 18 may be a durable, rigid lightweight material such as polypropylene, carbon or thermo plastic urethane (TPU), for example and without limitation. As illustrated in FIGS. 1 and 2, a front lock tab receptacle 19 and a rear lock tab receptacle 20 (illustrated in phantom) are provided in a front end and a rear end, respectively, of the lock bridge 18. As illustrated in FIG. 3, the front lock tab receptacle 19 is adapted to receive the lock tab 33 of the forefoot sole cartridge 30 when the forefoot sole cartridge 30 slidably engages the cartridge channels 14. In like manner, as illustrated in FIG. 2, the rear lock tab receptacle 20 is adapted to receive the lock tab 39 of the heel sole cartridge 36 when the heel sole cartridge 36 slidably engages the cartridge channels 14.

A tab lock mechanism 24 is provided in each lock bridge 18. Generally, the tab lock mechanism 24 may include a lock tab release button 25 which may be spring-loaded. A lock tab linkage 26 is engaged by the lock tab release button 25. Each lock tab linkage 26 is adapted to releasably engage the corresponding lock tab 33 of the forefoot sole cartridge 30 and the lock tab 39 of the heel cartridge 36 when the lock tab 33 is inserted in the front lock tab receptacle 19 and the lock tab 39 is inserted in the rear lock tab receptacle 20 of the lock bridge 18. Upon depression of the lock tab release button 25, each linkage 26 is adapted to release the corresponding lock tab 33, 39 and facilitate sliding of the forefoot sole cartridge 30 and the heel sole cartridge 36, respectively, on the cartridge channels 14 to remove the forefoot sole cartridge 30 and the heel sole cartridge 36 from the shoe frame 2. The tab lock mechanism 24 may have any design which facilitates releasable insertion of the lock tabs 33, 39 in the respective front lock tab receptacle 19 and rear lock tab receptacle 20 of the lock bridge 18, according to the knowledge of those skilled in the art.

In typical application, each shoe frame 2 of each pair of shoes 1 is available separately from each forefoot sole cartridge 30 and each heel sole cartridge 36. Accordingly, the forefoot sole cartridge 30 and heel sole cartridge 36 can be selected for attachment to the shoe frame 2 based on a particular sport which a user is to play while wearing the shoes 1. The forefoot sole cartridge 30 and the heel sole cartridge 36 are attached to the shoe frame 2 and attached to the lock bridge 18 typically by sliding each along the cartridge channels 14, as was heretofore described with respect to FIGS. 2 and 3. The lock tab 33 of the forefoot sole cartridge 30 is inserted in the front lock tab receptacle 19 and the lock tab 39 of the heel sole cartridge 36 is inserted in the rear lock tab receptacle 20 of the lock bridge 18. Each shoe 1 may be donned in the conventional manner. Throughout wearing of the shoes 1, the forefoot sole cartridge 30 and the heel sole cartridge 36 impart comfort, protection, strength and support to the feet of the wearer. Upon damage to or eventual wearing out of the forefoot sole cartridge 30 and/or the heel sole cartridge 36, either or both can be replaced on the shoe frame 2 by depression of the lock tab release button 25 on the lock bridge 18 to disengage the corresponding lock tab 33 on the forefoot sole cartridge 30 or lock tab 39 on the heel cartridge 36 from the lock bridge 18; and sliding of the damaged or worn out forefoot sole cartridge 30 and/or heel sole cartridge 36 forwardly and rearwardly, respectively, on the cartridge channels 14. The replacement forefoot sole cartridge 30 and heel sole cartridge 36 are slid along the cartridge channels 14 and locked into place in the lock bridge 18.

Figure 10:
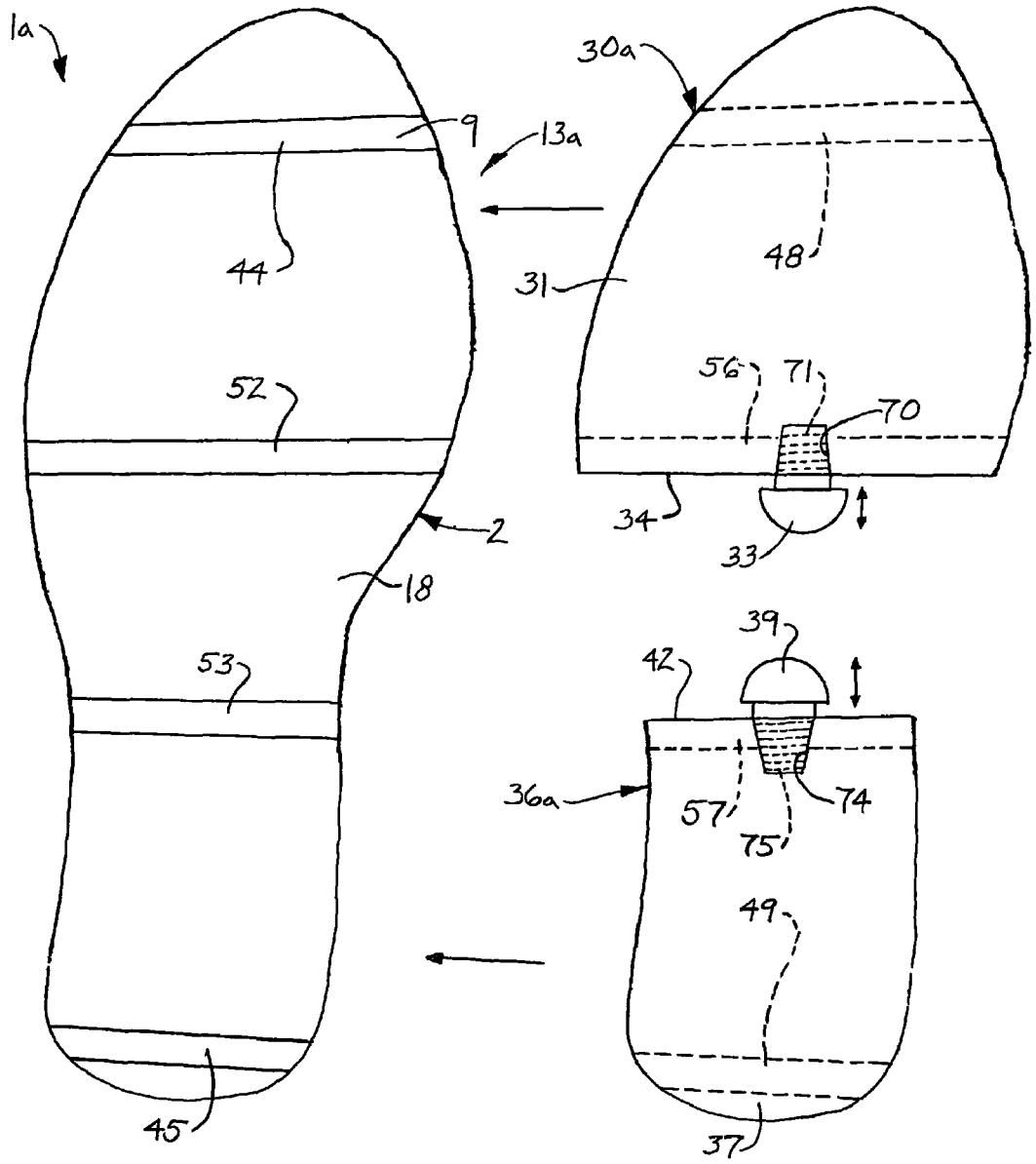
FIG. 10 is a bottom view of an alternative illustrative embodiment of the shoe with replaceable sole cartridges, more particularly illustrating lateral engagement of the forefoot sole cartridge and heel sole cartridge with the shoe frame.
Figure 11:
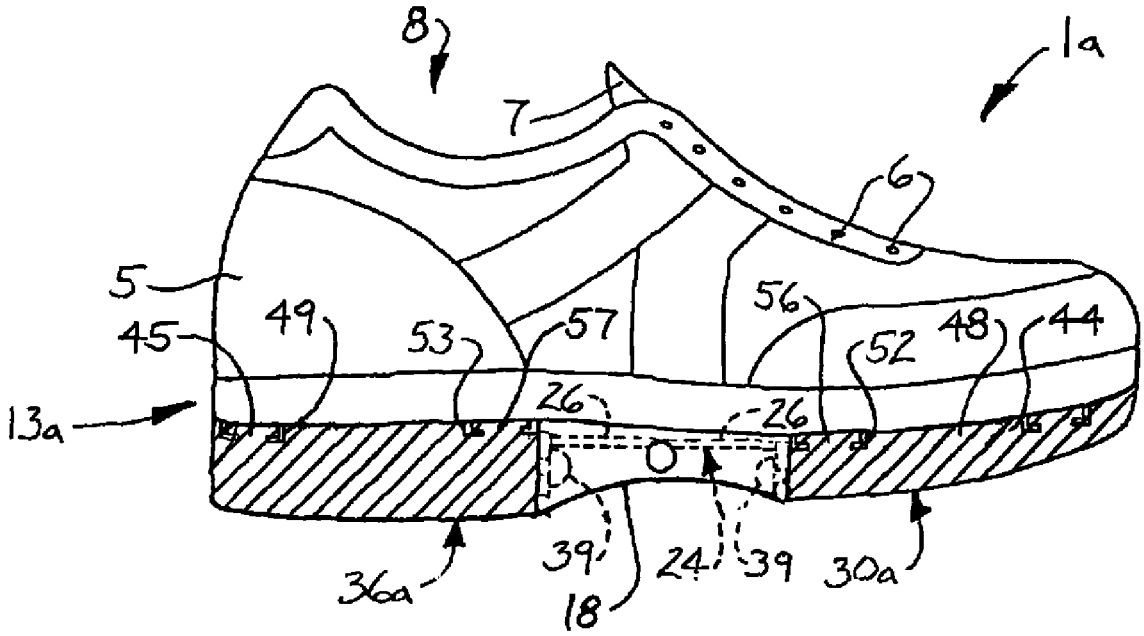
FIG. 11 is a side view of the shoe with replaceable sole cartridges illustrated in FIG. 10, with the forefoot sole cartridge and the heel sole cartridge attached to the shoe frame of the shoe.

Referring next to FIGS. 10 and 11 of the drawings, an alternative illustrative embodiment of the shoe with replaceable sole cartridge, hereinafter shoe, is generally indicated by reference numeral 1*a*. As illustrated in FIG. 10, the cartridge guiding and locking assembly 13*a* of the shoe 1*a* includes a transverse forefoot channel 44 and a transverse heel channel 45 provided on the sole 9 at the forefoot and heel portions, respectively, of the shoe frame 2 and a front midfoot channel 52 and a rear midfoot channel 53. The transverse forefoot channel 44, the transverse heel channel 45, the front midfoot channel 52 and the rear midfoot channel 53 are oriented in generally perpendicular relationship with respect to the longitudinal axis of the shoe frame 2. A forefoot sole cartridge 30*a* includes a forefoot cartridge body 31 having a transversely-mounted transverse forefoot rail 48 and a transversely-mounted front bridge rail 56. A heel cartridge 36*a* includes a heel cartridge body 37 having a transversely-mounted transverse heel rail 49 and a transversely-mounted rear bridge rail 57. Accordingly, the forefoot sole cartridge 30*a* is adapted for removable attachment to the shoe frame 2 by engaging the transverse forefoot rail 48 and front bridge rail 56 on the forefoot sole cartridge 30*a* with the respective transverse forefoot channel 44 and front midfoot channel 52 on the shoe frame 2. In like manner, the heel sole cartridge 36*a* is adapted for removable attachment to the shoe frame 2 by engaging the transverse heel rail 49 and rear bridge rail 57 on the heel sole cartridge 36*a* with the respective transverse heel channel 45 and rear midfoot channel 53 on the shoe frame 2. As further illustrated in FIG. 10, the lock tab 33 of the forefoot sole cartridge 30*a* may be spring-biased by a spring 71 which is mounted in a spring cavity 70 provided in the rear edge 34 of the forefoot cartridge body 31. In like manner, the lock tab 39 of the heel cartridge 36*a* may be spring-biased by a spring 75, which is mounted in spring cavity 74 provided in the front edge 42 of the heel cartridge body 37. The springs 71, 75 bias the lock tabs 33, 39 into the respective front lock tab receptacle 19 and rear lock tab receptacle 20 (FIG. 1) of the lock bridge 18 as the forefoot sole cartridge 30*a* and the heel sole cartridge 36*a* are slid into place on the shoe frame 2.

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A running shoe, comprising:

a frame of the running shoe, the frame having a forefoot portion, a middle portion extending from the forefoot portion and a heel portion extending from the middle portion;

a sole of the running shoe, the sole being provided on the frame of the running shoe and having a bottom surface;

a cartridge guiding and locking assembly having a first and a second pair of spaced-apart rail segments that are coupled with the bottom surface of the sole of the running shoe to define a channel that runs along and is centered about a longitudinal axis of the running shoe, the first pair of spaced-apart rail segments being carried on opposing sides of, and flush with, an outer edge of the bottom surface of the sole below the forefoot portion of the frame of the running shoe, and the second pair of spaced-apart rail segments being carried on opposing sides of, and flush with, the outer edge of the bottom surface of the sole below the heel portion of the frame of the running shoe;

a forefoot sole cartridge removably engaging the first pair of spaced-apart rail segments below the forefoot portion of the frame, the forefoot sole cartridge comprising a forefoot outer sole and a forefoot midsole, the forefoot midsole being affixed to the forefoot outer sole with the forefoot midsole being positioned between the sole and the forefoot outer sole when engaged with the sole, and wherein a shape and an area of the forefoot outer sole is at least as great as a shape and area of the sole below the forefoot portion of the frame;

a heel sole cartridge removably engaging the second pair of spaced-apart rail segments below the heel portion of the frame, the heel sole cartridge comprising a heel outer sole and a heel midsole, the heel midsole being affixed to the heel outer sole with the heel midsole being positioned between the sole and the heel outer sole when engaged with the sole, and wherein a shape and an area of the heel outer sole is at least as great as a shape and area of the sole below the heel portion of the frame;

a lock-bridge carried by the bottom surface of the sole below the middle portion of the frame between the first and the second pair of spaced-apart rail segments and not below the forefoot portion or the heel portion;

wherein each of the forefoot sole cartridge and the heel sole cartridge is adapted to detachably engage the lock bridge; and wherein the forefoot midsole and the heel midsole each comprise at least one of an EVA material or a polyurethane material.

2. The running shoe of claim 1, wherein the shoe frame comprises a nylon mesh.

3. The running shoe of claim 1, further comprising a lock tab provided on each of the forefoot sole cartridge and the heel sole cartridge and adapted to detachably engage the lock bridge.

4. The running shoe of claim 3, further comprising a release button provided on the lock bridge and adapted to releasably engage each lock tab.

* * * * *